US010100489B2

(12) United States Patent
Constancon et al.

(10) Patent No.: US 10,100,489 B2
(45) Date of Patent: Oct. 16, 2018

(54) STRUCTURAL CONNECTORS FOR DRAGLINE BOOM AND MAST TUBULAR CLUSTERS AND METHODS FOR REPAIR, REINFORCEMENT AND LIFE EXTENSION OF DRAGLINE BOOMS AND MASTS

(71) Applicant: BMT WBM Canada Consulting Engineers Inc., Vancouver (CA)

(72) Inventors: Charles Peter Constancon, North Vancouver (CA); Arlon John Thomas Ratcliff, Richmond (CA); Harold Bydemast, Surrey (CA)

(73) Assignee: BMT WBM Canada Consulting Engineers Inc., Vancouver (CA)

( * ) Notice: Subject to any disclaimer, the term of this patent is extended or adjusted under 35 U.S.C. 154(b) by 325 days.

(21) Appl. No.: 14/333,209

(22) Filed: Jul. 16, 2014

(65) Prior Publication Data

US 2015/0030378 A1 Jan. 29, 2015

Related U.S. Application Data

(60) Provisional application No. 61/859,235, filed on Jul. 28, 2013.

(51) Int. Cl.

| | |
|---|---|
| ***E02F 3/48*** | (2006.01) |
| ***E02F 3/58*** | (2006.01) |
| ***E02F 9/14*** | (2006.01) |
| ***E04B 1/19*** | (2006.01) |
| *E04B 1/24* | (2006.01) |

(52) U.S. Cl.

CPC ..... *E02F 3/58* (2013.01); *E02F 3/48* (2013.01); *E02F 9/14* (2013.01); *E04B 1/1903* (2013.01); *E04B 2001/2406* (2013.01); *E04B 2001/2415* (2013.01); *Y10T 403/44* (2015.01)

(58) Field of Classification Search

CPC ..... E02F 3/48; E02F 3/58; E02F 9/14; E04B 1/1903; E04B 2001/1918; E04B 2001/1921; E04B 2001/1957; E04B 2001/1966; E04B 2001/1972; E04B 2001/2406; E04B 2001/2415; E04B 2001/2421; E04B 2001/2445; E04B 2001/2448;

(Continued)

(56) References Cited

U.S. PATENT DOCUMENTS 1,760,883 A * 6/1930 Moss ..... E04B 1/585 29/897.31
2,189,201 A * 2/1940 Flader ..... E04B 1/585 219/137 R (Continued)

FOREIGN PATENT DOCUMENTS

DE 925325 C * 3/1955 ..... E04B 1/585
FR 2458329 A1 * 1/1981 ..... B21D 39/044

(Continued)

*Primary Examiner* — Ryan D Kwiecinski

(74) *Attorney, Agent, or Firm* — Oyen Wiggs Green & Mutala LLP

(57) ABSTRACT

A construction for a boom such as a dragline boom provides a spade plate that connects lacing members to a main chord at a cluster. The spade plate is curved. One edge of the spade plate has tabs attached to the lacing members. Another edge of the spade plate is attached to the main chord. The spade plate may be applied for new construction or repair.

44 Claims, 14 Drawing Sheets

(58) Field of Classification Search
CPC ..... E04B 2001/2496; Y10T 403/44; Y10T 403/4642; Y10T 403/73
USPC ..... 52/655.1; 403/217, 245, 403
See application file for complete search history.

(56) References Cited

U.S. PATENT DOCUMENTS

| | | | | | |
|---|---|---|---|---|---|
| 2,477,260 | A * | 7/1949 | Wilder | E04B 1/585 | 219/105 |
| 3,323,660 | A * | 6/1967 | Allin, Sr. | B66C 23/70 | 212/177 |
| 4,746,056 | A * | 5/1988 | Thomsen | E04B 1/585 | 228/170 |
| 5,937,496 | A * | 8/1999 | Benoit | B21D 26/14 | 280/281.1 |
| 6,056,240 | A * | 5/2000 | Hagenlocher | B64B 1/08 | 244/125 |
| 7,568,253 | B2 * | 8/2009 | de la Chevrotiere | E01D 6/00 | 14/14 |
| 2015/0107181 | A1 * | 4/2015 | Larsen | E04B 1/1903 | 52/655.1 |

FOREIGN PATENT DOCUMENTS

| | | | | |
|---|---|---|---|---|
| FR | 2503288 | A1 * | 10/1982 | B64G 9/00 |
| WO | WO-2013185769 | A1 * | 12/2013 | E04B 1/1903 |
| WO | WO-2013185770 | A1 * | 12/2013 | B21C 37/296 |

* cited by examiner

STRUCTURAL CONNECTORS FOR DRAGLINE BOOM AND MAST TUBULAR CLUSTERS AND METHODS FOR REPAIR, REINFORCEMENT AND LIFE EXTENSION OF DRAGLINE BOOMS AND MASTS

CROSS-REFERENCE TO RELATED APPLICATION

This application claims the benefit under 35 U.S.C. § 119 of U.S. Application No. 61/859,235 filed 28 Jul. 2013 and entitled STRUCTURAL CONNECTORS FOR DRAGLINE BOOM AND MAST TUBULAR CLUSTERS AND METHODS FOR REPAIR, REINFORCEMENT AND LIFE EXTENSION OF DRAGLINE BOOMS AND MASTS which is hereby incorporated herein by reference for all purposes.

TECHNICAL FIELD

This invention relates to heavy equipment. The invention has particular application to draglines and other equipment having extended booms with tubular chords or lacings. The invention may be used to repair old booms or in the manufacture of new booms.

BACKGROUND

Dragline excavators have long booms which comprise a number of main tubular chords connected by tubular lacing. The tubular lacing is connected to the main chords at cluster joints. FIG. 1 illustrates a typical cluster joint and the complex intersection between the lacings and the chord. Dragline booms are called upon to support large dynamic loads. Stresses tend to be concentrated at the cluster joint weldments at which the lacing is connected to the main chord. Over time, these stresses cause fatigue failures at the cluster joints. With increased productivity demands and cost of machine down time, failure of cluster joints on the current tubular dragline boom design requires temporary weld repair until a sufficiently long outage is available to lower the boom and complete a repair under controlled conditions. Such temporary weld repair may be performed under adverse conditions. Even under controlled conditions with the boom lowered, the fatigue life of the repaired cluster joint is undesirably short.

Aside from the limited maintenance schedules which generally preclude lowering the boom and the outage cost associated with such an operation, lowering the boom is viewed by operators as a dangerous exercise exposing the operator to a potentially high risk event with significant financial consequences.

Conventional tubular boom structures typically have about 10% of the welds hidden from view by the overlapping nature of the cluster joint design. This makes routine inspection impossible. Even locating cracks by pressurizing chords of the boom and finding air leaks can be difficult.

Numerous failures of cluster joints on tubular booms have occurred throughout the world, some leading to catastrophic collapse of the boom.

Failures of cluster joints may be initiated by the growth of fatigue cracks at welds connecting the secondary lacings and the main chord. These regions are associated with high stress concentrations arising from the cluster geometry as well as the presence of weld beads. Where clusters have been weld repaired in situ, the fatigue life of the joint can be reduced due to incomplete penetration of the weld, inclusion of contaminants, irregular internal and external weld geometry and the generation of high residual stresses due to the welding process. If a failure at a cluster involves the main chord material it can be necessary to cut a window to gain access to the main chord and allow for repair of the chord through the window. After the repair is completed the window must be re-inserted and welded in place. This repair is difficult to conduct and causes damage to the cluster as a consequence of the constraints of the repair i.e. weld profile grinding or post weld dressing techniques are difficult to apply.

There is a need for dragline booms that have increased service lives. There is also a need for methods for repairing failures or defects in dragline booms in situ or when the boom is lowered, which avoid at least some of the disadvantages of current methods.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

FIGS. 3A to 3C also illustrate the curved spade connector using plugs inserted into the lacing or sleeves which receive ends of the lacing to allow for axial and rotational alignment between the curved spade plate and the lacing.

DESCRIPTION

Figure 1:
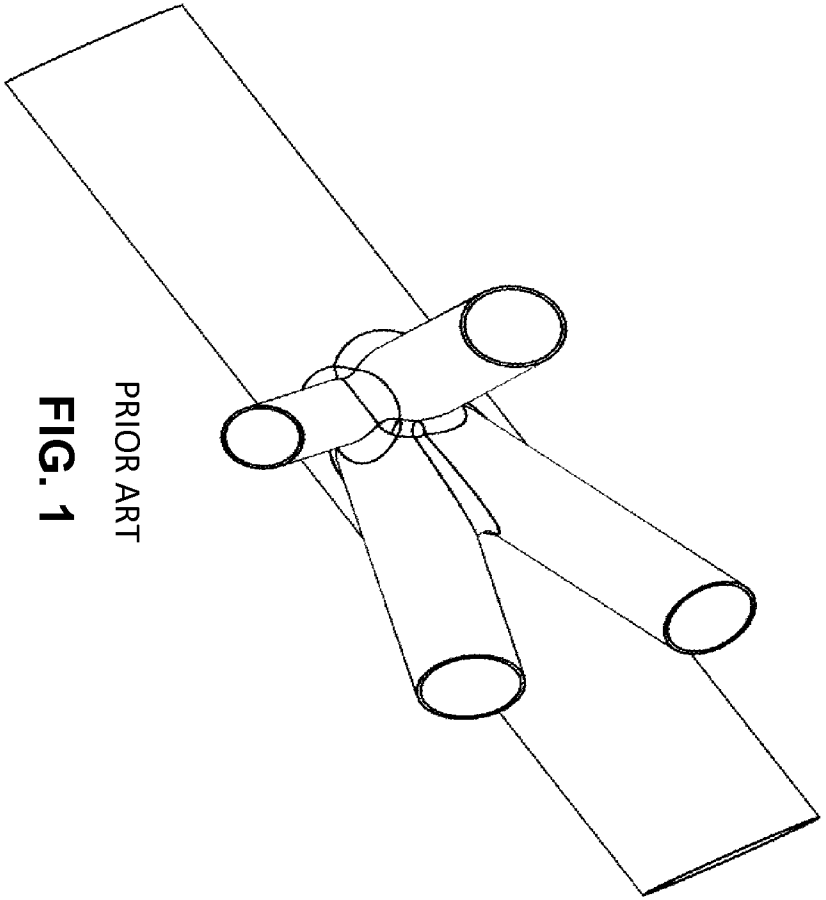
PRIOR ART FIG. 1
FIG. 1 is a drawing of a typical cluster arrangement applied on a tubular dragline boom, for example Bucyrus™ type dragline booms.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

This invention relates to a construction for dragline booms and similar boom structures. The construction may be applied to newly fabricated booms and also has application in repairing existing booms. The construction may be retrofitted to existing booms. The construction comprises a curved spade plate that provides an interface between a main chord of a boom and tubular lacing at a cluster joint. The curved spade plate connector can be accurately manufactured to match the cluster geometry. Use of the curved spade connector thereby avoids the need for complex three-dimensional weld geometry where the lacings come together with the chord. In some embodiments, the curved spade plate is connected to the tubular lacing members with plugs that fit into the tubular lacing members and can be rotated to provide axial and rotational alignment to corresponding connection features on the curved spade plate before they are welded in place.

A method for repairing a boom using a spade plate connector as described herein advantageously permits cutting away the lacings from the chord, thereby providing access to remove damaged or previously-repaired material. The exposed chord can be inspected and fully weld repaired before installing the spade plate. The method may be applied to a tubular dragline boom, for example to a Bucyrus™ type boom with tubular cluster joints, and presents a new method for repairing these clusters in a manner that can be performed efficiently and that can provide significantly improved fatigue life as compared to currently-used repair techniques. In some embodiments the method involves inserting plugs into ends of the cut-off lacing members, adjusting rotations and/or extensions of the plugs to align connecting features on the plugs with corresponding connecting features on the curved spade plate and then welding the plugs to the lacing members and to the curved spade plate. The curved spade plate is also welded to the main chord of the boom to provide a connection between the main chord and the lacing members.

One aspect of the invention provides a curved spade joint connector that has application in tubular dragline booms, for example on Bucyrus™ draglines. The cluster joints may be installed in situ without requiring lowering of the boom if adequate jigging is engineered to support the joint in this condition. Connectors as described herein may be installed during manufacture of a boom or installed during a repair, either in situ, or with the boom lowered.

Another aspect of the invention provides a boom, for example a dragline boom, comprising a cluster joint made with a spade connector as described herein. The boom may have a plurality of main chords. Lacing members may extend between spade connectors on different ones of the main chords. In some embodiments, the boom comprises a plurality of tubular main chords each having a plurality of cluster joints spaced apart along it. Each of the cluster joints comprises one or more spade connectors as described herein. Lacing members extend between the spade connectors on different ones of the main chords.

Figure 3A:
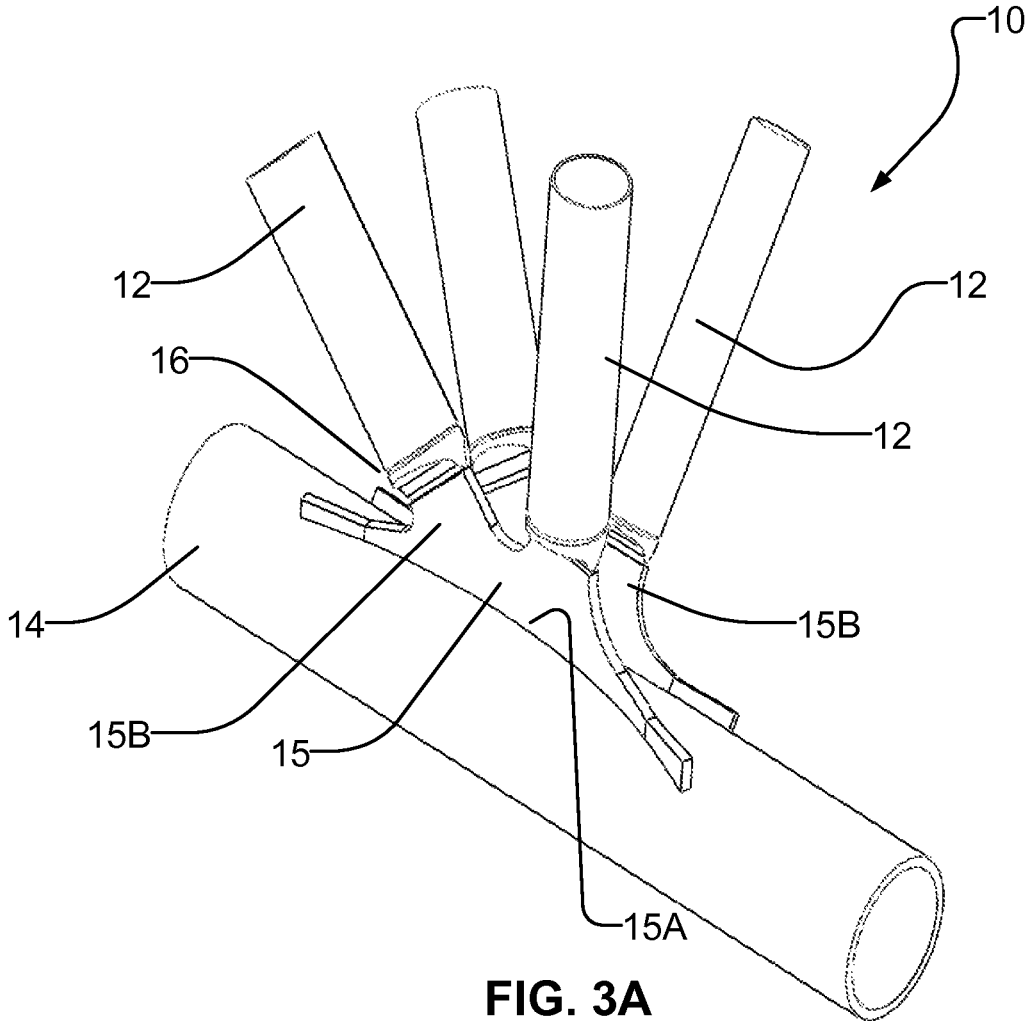
FIGS. 3A, 3B and 3C make up a set of drawings of a curved spade weld-on connector installed in a boom cluster. Various views of the cluster are illustrated.
Figure 3B:
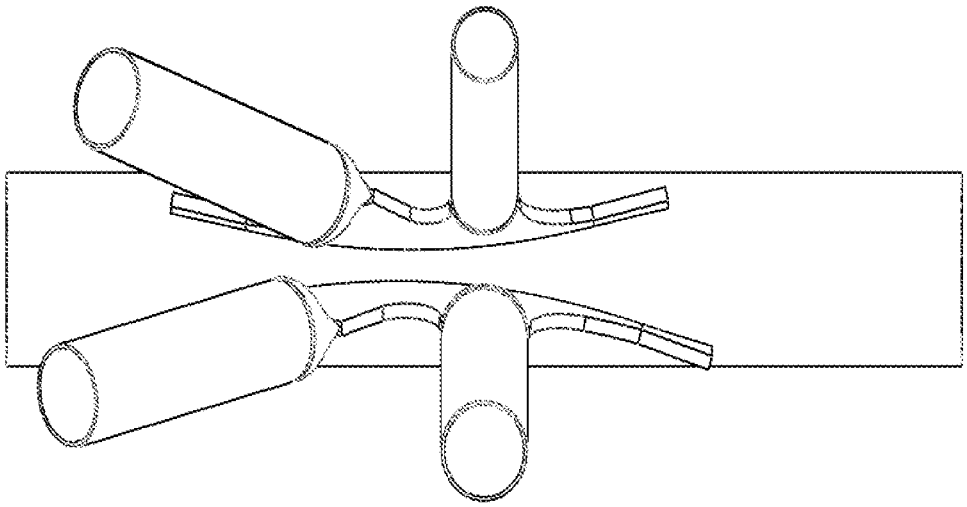
Figure 3C:
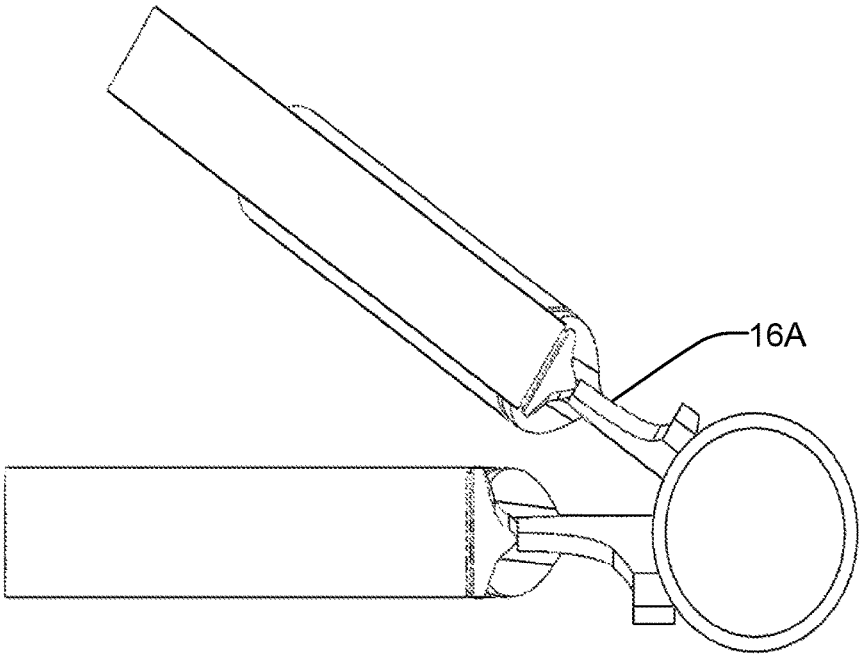

FIGS. 3A to 3C show an example cluster joint 10 in a boom. Cluster joint 10 connects tubular lacing members 12 to main chord 14. Cluster joint 10 comprises spade plates 15. Each spade plate 15 has a curved elongated edge 15A connected to main chord 14 and projecting tabs 15B to which lacing members 12 may be coupled.

In the illustrated embodiment, lacing members 12 are coupled to spade plates 15 by way of coupling members 16 that are initially (until welded in place) rotatable and axially extendable relative to lacing members 12. Coupling members 16 may, for example, comprise plugs insertable into the bores of lacing members 12. Coupling members 16 may comprise slots 16B dimensioned to receive tabs 15B. In some alternative embodiments, coupling members 16 comprise sleeves 16A having inner diameters dimensioned to receive lacing members 12.

Figure 2:
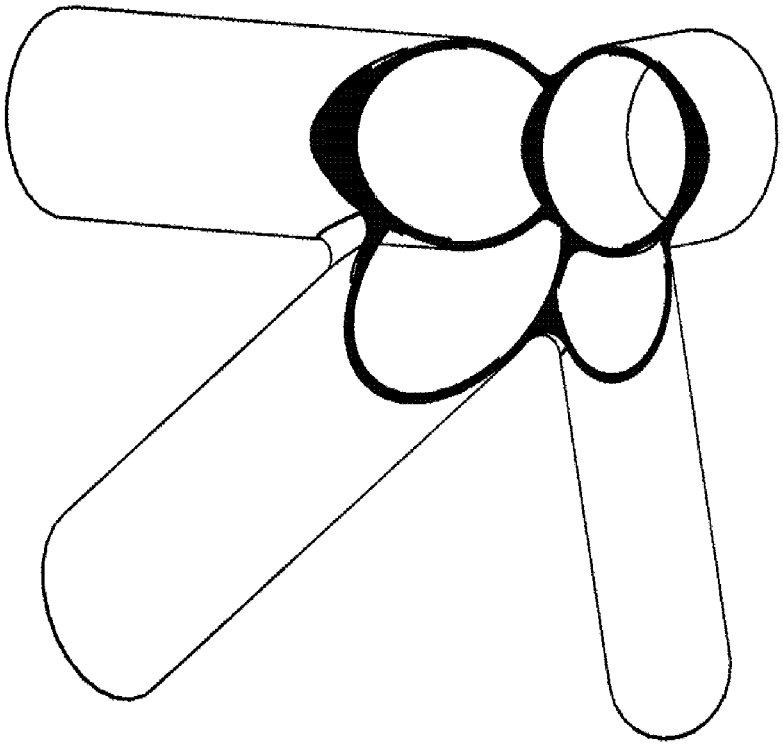
PRIOR ART FIG. 2
FIG. 2 is a cross section view showing the complex weld geometry arising at the lacing/chord intersection/interface.

Cluster joint 10 has a number of advantages over prior art cluster joints as illustrated, for example in FIGS. 1 and 2. The curved spade plate design strengthens the chord in the circumferential direction, avoiding high localized stresses. This improves the fatigue life of the cluster joint. The weld between curved spade connector 15 and main chord 14 lies generally along the axis of main chord 14. The weld location is easily accessible to facilitate high quality full penetration welds. Since the weld holding curved spade plate 15 to main chord 14 extends predominantly parallel rather than transverse to the stress in the chord, which facilitates a longer fatigue life of the weld.

Figure 4A:
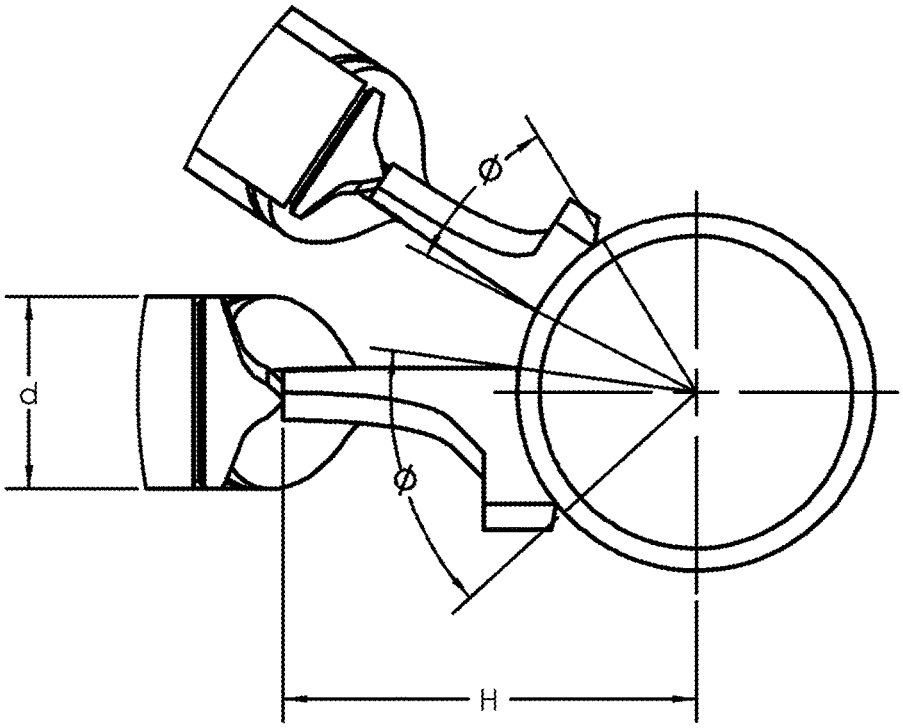
FIGS. 4A and 4B are schematic drawings showing example dimensional relationships between dimensions of the cluster joint. Optimum dimensions for specific applications may be determined using FEA (finite element analysis).
Figure 4B:
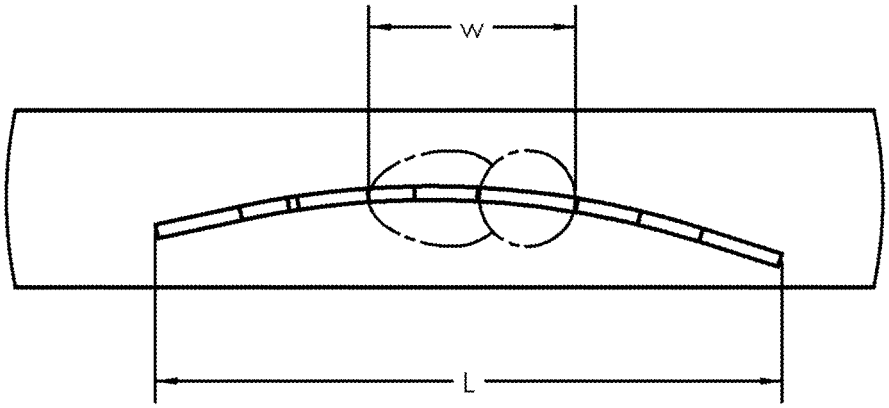

FIGS. 4A and 4B show example dimensional relationships between dimensions of a typical cluster joint. These dimensional relationships are generic rules based on research conducted to date. An optimal design for a specific application may be generated by modelling the specific cluster joint under consideration and applying tools such as finite element analysis to generate a configuration that provides required strength while reducing stresses under expected operating conditions to an acceptable level.

As illustrated in FIG. 4A, in some preferred embodiments $1 \leq H/d \leq 2$ where d is the lacing diameter and H is the height of the spade plate as measured from the main chord. In some preferred embodiments $20° \leq \varphi \leq 45°$ where $\varphi$, as shown, is the angle subtended on main chord 14 as a result of the curvature of curved spade plate 15. As shown in FIG. 4B, in some preferred embodiments $2 \leq L/w \leq 5$ where L is the length of spade plate 15 measured along the longitudinal axis of main chord 14 and w is the length measured along the longitudinal axis of main chord 14 of the projections onto the main chord of the lacing members connected to spade plate 15.

Figure 5A:
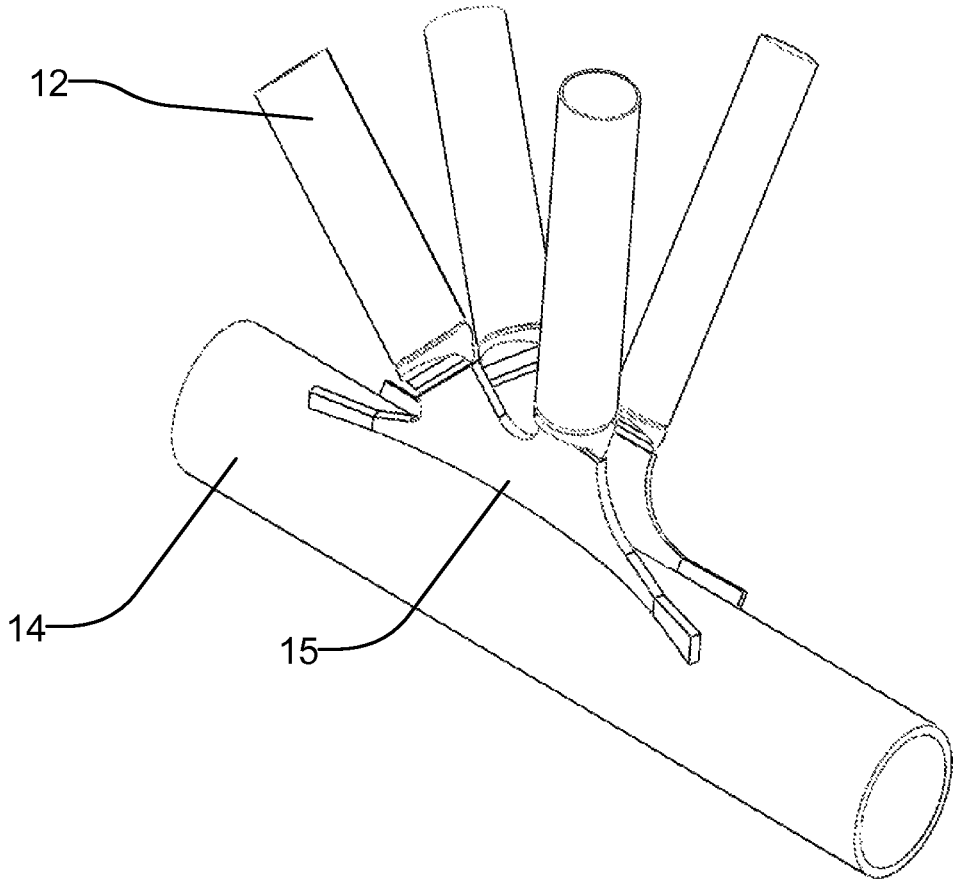
FIGS. 5A, 5B and 5C illustrate typical connector details.
Figure 5B:
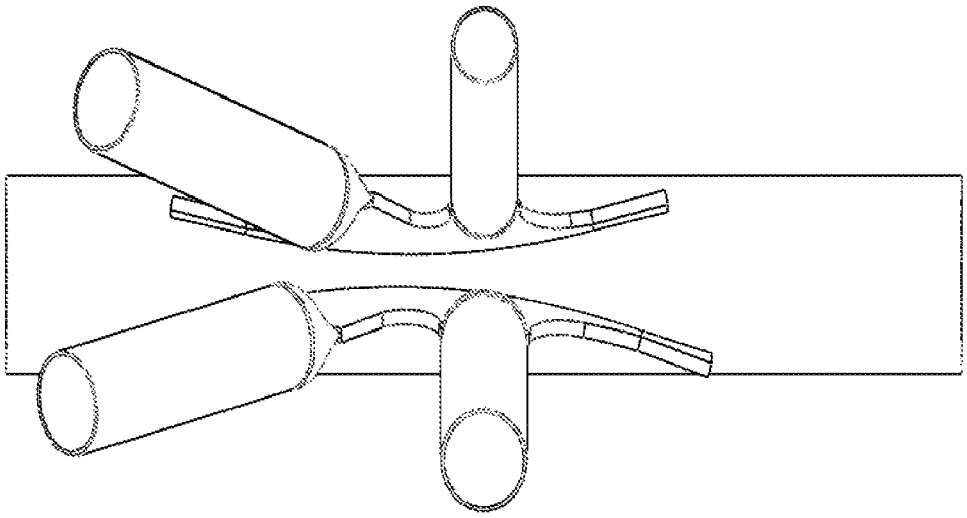
Figure 5C:
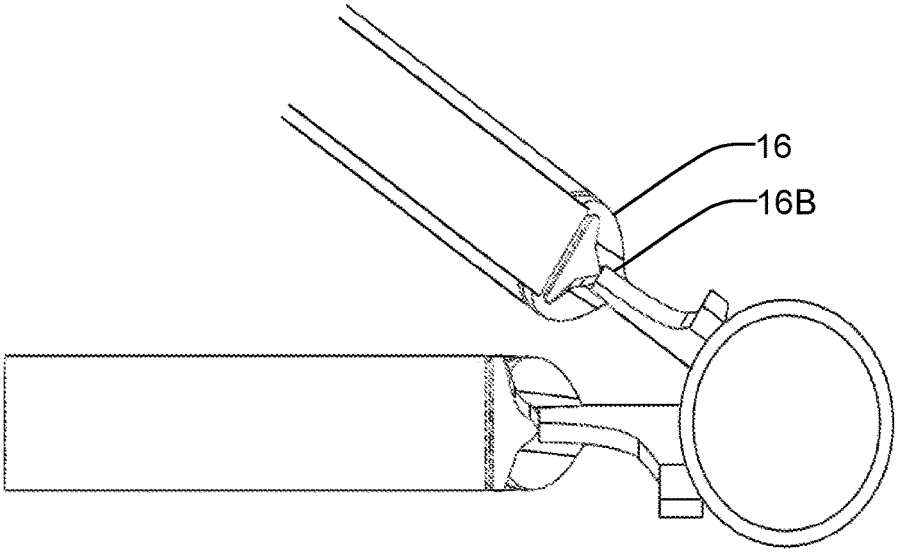

FIGS. 5A to 5C show application of a spade plate connector designated generally by the reference 15. Connector 15 may be cast or forged or cut or milled from rolled plate, for example. Plugs 16 are inserted into lacing members 12 and allow for axial and rotational alignment to connector 15 prior to being welded in place. In some embodiments a plug 16 comprises a portion dimensioned to be received within a bore of a lacing member 12 and a flange which can bear against an end of the lacing member 12. The plug 16 may be fastened to the lacing member 12 with a circumferential weld.

Figure 6:
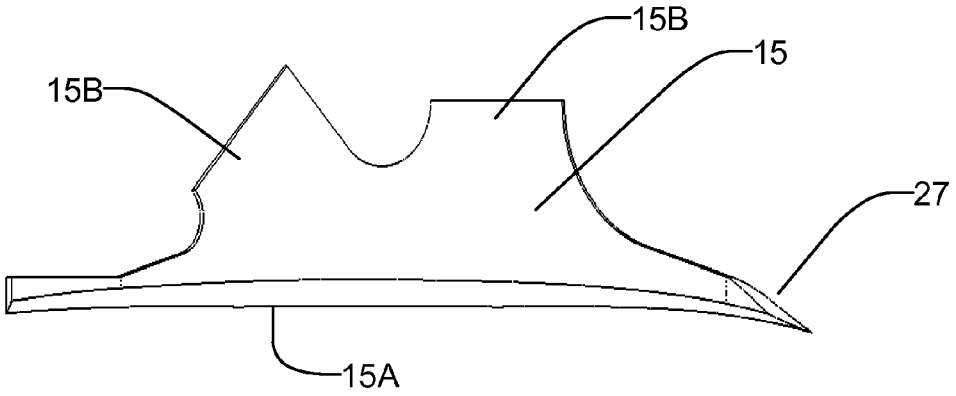
FIG. 6 illustrates example connector weldment details.

The curved plate geometry of connector 15 facilitates self-alignment of connector 15 to the axis of the main chord 14. Geometric details 27 (see FIG. 6) may be applied to connector 15 to reduce potential stress concentration effects at one or both ends of the side 15A of curved spade connector 15 that is joined to main chord 14. The actual geometry of connector 15 will vary according to the cluster geometry (e.g. the angles at which lacing members 12 approach main chord 14, the diameters of lacing members 12, the diameter of main chord 14 etc.).

Where a cluster joint uses two spade plates (as shown for example in FIG. 5B) convex sides of the spade places may face one another. Where a cluster joint uses two spade plates the spade plates may be constructed do that their ends are staggered along the length of main chord 14.

Connector 15 may be prepared for welding attachment to main chord 14 by bevelling or chamfering edge 15A to facilitate attachment to main chord 14 with a full penetration weld.

Figure 7:
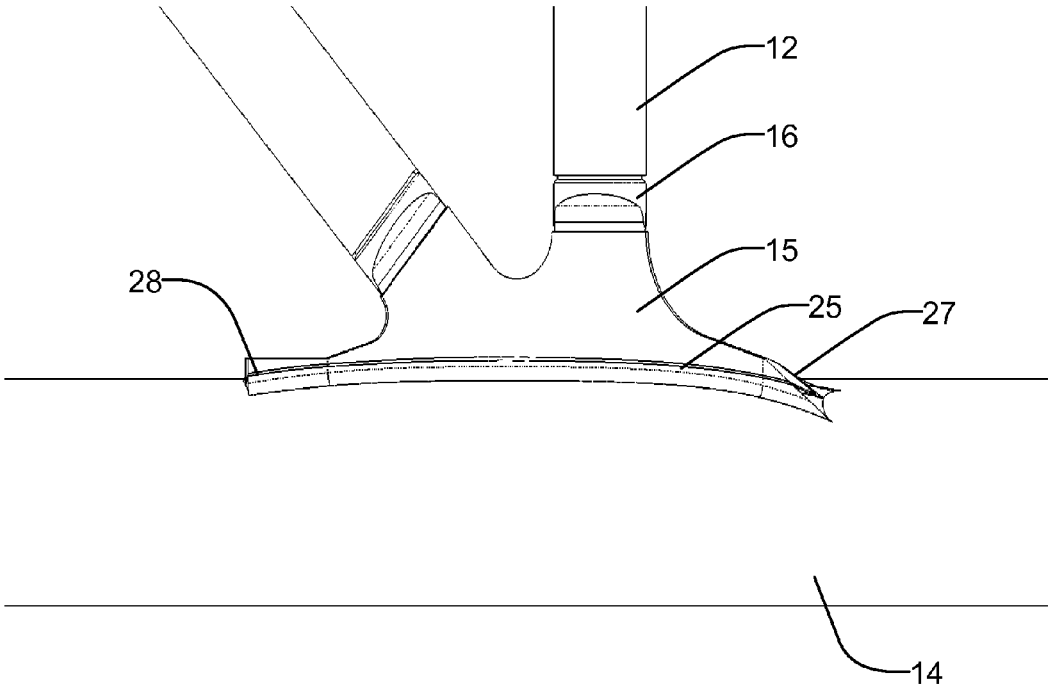
FIG. 7 illustrates regions for post weld dressing.

FIG. 7 illustrates post weld methods that may be applied for improving the life span of a cluster joint 10. Weld 25 may be re-enforced and profile ground. After profiling, shot or ultrasonic peening may be applied as a post weld treatment to improve the fatigue life of weld 25. Nose detail 28 may be trimmed and profile ground to reflect the profiling of weld 25 at end 27.

In the illustrated embodiments, connector 15 is aligned along the axis of the primary member or chord 14. This reduces the exposure of weld transverse to the longitudinal axis of the primary member thereby increasing the fatigue life of connector weld 25.

A connector 10 may be installed at a cluster joint of a dragline boom by cutting out sections of the lacing members 12 that meet at the cluster joint. The primary member (e.g. main chord 14) can then be weld repaired to a high quality since there is ample access to the location at which the lacing members were formerly attached to the primary member. Each lacing member is cut back to the correct length to so that the plug 16 can mate with the appropriate tab of curved spade plate connector 15. Connector 15 is then positioned on the main chord 14 of the boom. At a suitable point after the spade connector 15 has been positioned on the main chord so that it aligns with the plugs 16, connector 15 is welded to main chord 14. Then the secondary lacing members 12 are connected to the spade plate connector 15 by welding plugs 16 onto lacing members 12 and by welding plugs 16 to connector 15. After welding, the welds may be profile ground to further reduce stress concentration effects associated with the weld profile. Further post-weld dressing such as shot or ultrasonic peening may be applied to improve the life of the repaired material by inducing a surface layer of residual compressive stress.

Although the present invention has been described with reference to the illustrated embodiments thereof, it should be understood that numerous other modifications and embodiments can be devised by those skilled in the art that will fall within the spirit and scope of the principles of this invention. For example, the features described herein and/or shown in the accompanying drawings may be combined in any suitable combinations or sub-combinations including those that are described herein. Further, the embodiments and features may be modified and/or added to ways that would be inferred by those skilled in the art from this description and/or the accompanying drawings.

Figure 8A:
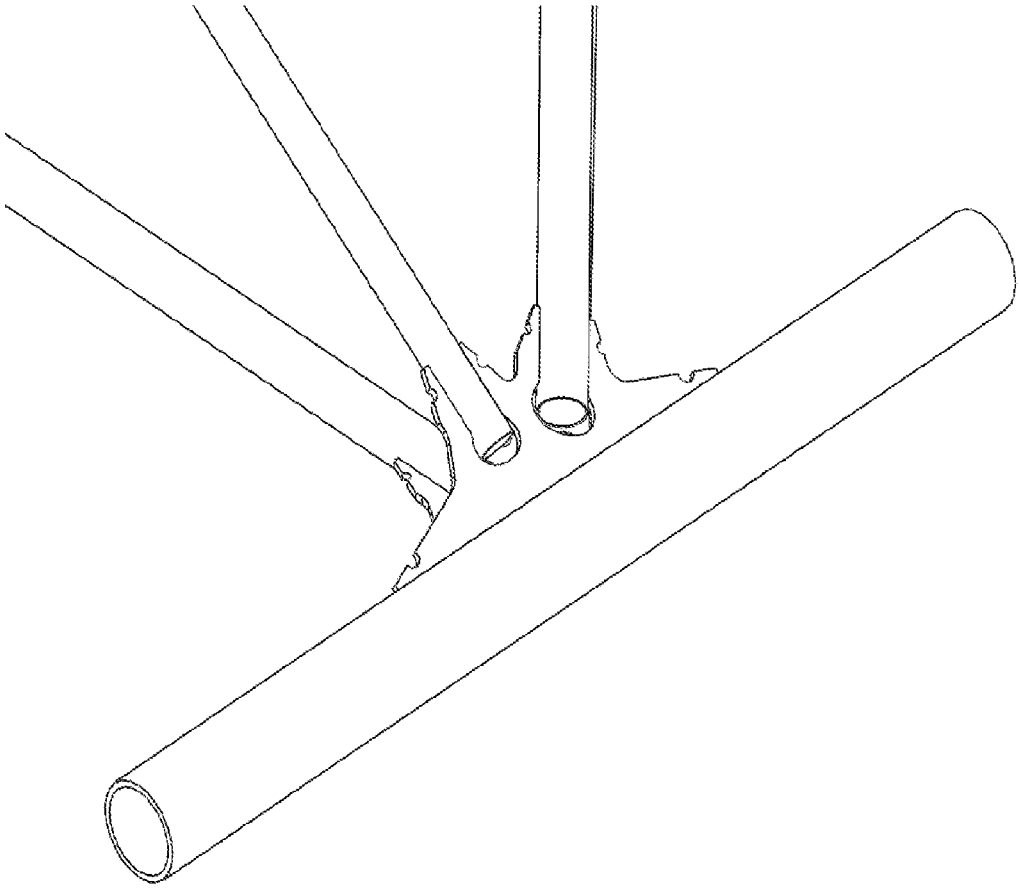
FIGS. 8A and 8B illustrates alternative embodiments which incorporate flat plate connectors.
Figure 8B:
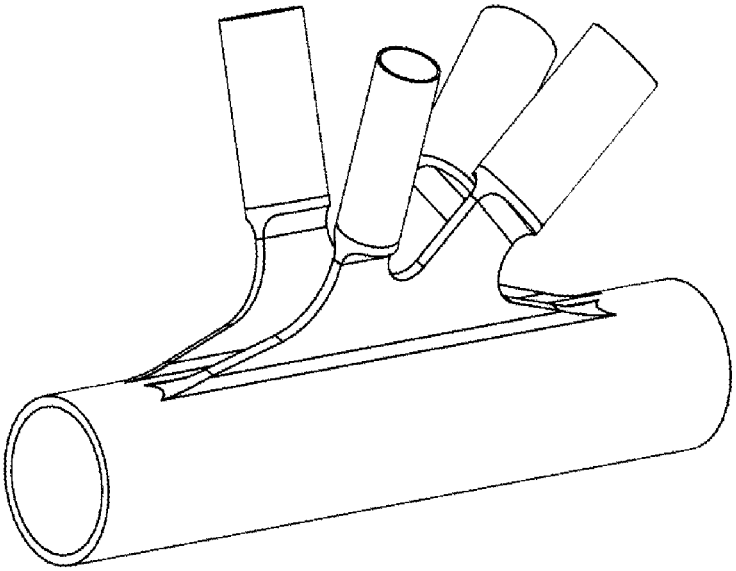

For example FIG. 8A shows an alternative embodiment with a planar spade connector and machined slots cut in the connector to receive the lacings. An alternative with machined plugs or adjustable inserts to improve the transition between the lacing and spade connector is illustrated in FIG. 8B.

In other non-preferred alternative embodiments, connector plates may have the form of flat plates bent along one or more discrete bend lines to provide a concave face and a convex face as opposed to being continuously curved as illustrated, for example, in FIGS. 5A to 5C. Such connector plates may have discrete flat planes separated by bend regions to construct an effective plate curvature.

An advantage of the embodiments illustrated in the drawings is that, after repair, main chord 14 is exposed (where it was previously covered by the cluster joint) and therefore easily accessed for inspection and any necessary future repairs.

What is claimed is:

1. A boom comprising a cluster joint, the cluster joint comprising:

a curved spade connector attached to a main chord of the boom, the curved spade connector having a concave side facing to one side of the main chord and a convex side facing an opposing side of the main chord and a curved first edge welded to the main chord by one or more welds extending generally along a longitudinal axis of the chord wherein the spade connector is configured such that the spade connector leaves at least that part of the main chord immediately adjacent to the first edge exposed to the exterior of the boom for inspection completely along each of the concave and convex sides of the spade connector; and a plurality of lacing members connected to connection locations on the curved spade connector, the connection locations comprising tabs formed in and spaced apart along a second edge of the spade connector opposed to the first edge.

2. A boom according to claim 1 wherein one or more of the plurality of lacing members is connected to a corresponding one of the tabs by way of a plug inserted into an end of the lacing member and attached to the lacing member and to the corresponding tab.

3. A boom according to claim 2 wherein the plug comprises a flange bearing on an end of the lacing member.

4. A boom according to claim 1 wherein one or more of the plurality of lacing members is connected to the corresponding tab by a connector comprising a sleeve that receives an end of the lacing member and is attached to the lacing member and the corresponding tab.

5. A boom according to claim 1 wherein the second edge is smoothly curved between adjacent ones of the tabs.

6. A boom according to claim 1 wherein the spade connector comprises a steel plate shaped to provide the tabs and bent in a curve such that a first face of the plate provides the convex side and a second face of the plate opposed to the first face provides the concave side.

7. A boom according to claim 1 wherein $1 \leq H/d \leq 2$ where d is a diameter of one of the lacing members and H is a height of the spade connector as measured from a point of attachment of the spade connector to the main chord.

8. A boom according to claim 1 wherein $20 \leq \varphi \leq 45°$ where $\varphi$ is an angle subtended on the main chord by the spade connector relative to a longitudinal axis of the main chord.

9. A boom according to claim 1 wherein $2 \leq L/w \leq 5$ where L is a length of the spade connector measured along a longitudinal axis of the main chord and w is a length measured along the longitudinal axis of the main chord of projections onto the main chord of the lacing members connected at the cluster joint to the spade connector.

10. A boom according to claim 1 wherein the spade connector is a first spade connector and the cluster joint comprises the first spade connector and a second curved spade connector having a convex side and a concave side, the second spade connector connecting one or more additional lacing members to the main chord.

11. A boom according to claim 10 wherein the convex side of the first spade connector faces the convex side of the second spade connector.

12. A boom according to claim 1 wherein the spade connector is made of steel.

13. A boom according to claim 12 wherein the spade connector is made of forged or cast steel.

14. A boom according to claim 1 wherein the spade connector is thickened in one or more areas of stress concentration.

15. A boom according to claim 1 wherein the spade connector is smoothly curving along a length of the spade connector.

16. A boom according to claim 1 wherein the spade connector comprises a plurality of planar portions separated by bends.

17. A boom according to claim 1 wherein the main chord is one of a plurality of main chords and each of the lacing members extends between the spade connector and another spade connector on another one of the main chords.

18. A boom according to claim 1 wherein the main chord is cylindrical and the first edge of the spade plate is configured with a cylindrical geometry to fit against a cylindrical surface of the main chord.

19. A boom according to claim 1, wherein a longitudinal plane of at least one of the tabs substantially aligns with an axial center line of a corresponding one of the plurality of lacing members.

20. A boom according to claim 1, wherein ends of the plurality of lacing members are spaced apart from the boom by a distance at least equal to a distance between the first and second edges of the curved spade connector.

21. A boom according to claim 1 wherein the one or more welds comprise a full penetration weld.

22. A boom comprising a cluster joint, the cluster joint comprising:

a curved spade connector attached to a main chord of the boom, the curved spade connector having a concave side facing to one side of the main chord and a convex side facing an opposing side of the main chord; and a plurality of lacing members connected to connection locations on the curved spade connector;

wherein:

the connection locations comprise tabs projecting from the curved spade connector;

one or more of the lacing members is connected to the corresponding tab by way of a plug inserted into an end of the lacing member and attached to the lacing member and to the corresponding tab; and an end of the plug is formed to provide a slot and the corresponding tab is received in the slot.

23. A boom comprising a cluster joint, the cluster joint comprising:

a curved spade connector attached to a main chord of the boom, the curved spade connector having a concave side facing to one side of the main chord and a convex side facing an opposing side of the main chord; and a plurality of lacing members connected to connection locations on the curved spade connector;

wherein the spade connector is a first spade connector and the cluster joint comprises the first spade connector and a second spade connector each connecting one or more of the lacing members to the main chord, the convex side of the first spade connector faces a convex side of the second spade connector, and the first spade connector extends longitudinally past an end of the second spade connector in a first direction along the main chord.

24. A boom according to claim 23 wherein the second spade connector extends longitudinally past an end of the first spade connector in a second direction opposed to the first direction along the main chord.

25. A boom comprising a cluster joint, the cluster joint comprising:

a curved spade connector attached to a main chord of the boom, the curved spade connector having a concave side facing to one side of the main chord and a convex side facing an opposing side of the main chord; and a plurality of lacing members connected to connection locations on the curved spade connector wherein:

the spade connector is a first spade connector and the cluster joint comprises the first spade connector and a second spade connector each connecting one or more of the lacing members to the main chord, the convex side of the first spade connector faces a convex side of the second spade connector, and ends of the first and second spade connectors are staggered longitudinally along the main chord.

26. A dragline comprising a boom according to claim 1.

27. A spade connector for use in coupling lacing members to a main chord of a boom, the spade connector comprising a one-piece curved plate having a concave face and a convex face, a first edge for connection to the main chord of the boom, a second edge of the curved plate opposed to the first edge shaped to provide a plurality of tabs, the plurality of tabs projecting from and spaced apart along the second edge wherein the first edge is configured with a cylindrical geometry to fit against a cylindrical surface of the main chord and the spade connector is configured such that when the first edge is fit against the cylindrical surface of the main chord, weld locations extending completely along each of the concave face and the convex face adjacent to the main chord are accessible for welding the plate to the main chord and, with the spade connector welded to the main chord by one or more welds, the spade connector leaves that part of the main chord immediately adjacent to the first edge exposed to the exterior of the boom for inspection along the full length of the spade connector on each of the concave and convex faces.

28. A spade connector according to claim 27 wherein the tabs are angled such that centerlines of the tabs converge in a direction towards the first edge.

29. A spade connector according to claim 27 wherein the first edge is beveled along sides of the first edge.

30. A spade connector according to claim 27 wherein the spade plate subtends an angle in the range of 20° to 45° with respect to a longitudinal axis of the cylindrical geometry.

31. A spade connector according to claim 30 wherein the plate is made of steel.

32. A spade connector according to claim 31 wherein the plate is forged or cast steel.

33. A spade connector according to claim 27 wherein the spade plate is thickened in one or more areas of stress concentration.

34. A spade connector according to claim 27 wherein the second edge is smoothly curved between adjacent ones of the tabs.

35. A kit comprising a spade connector according to claim 27 and one or more sleeves for interfacing the spade connector to lacing members of a boom.

36. A kit comprising a spade connector according to claim 27 and one or more plugs for interfacing the spade connector to lacing members of a boom.

37. A kit comprising a spade connector for coupling lacing members to a main chord of a boom and one or more plugs for interfacing the spade connector to lacing members of a boom wherein the spade connector comprises a one-piece curved plate having a concave face and a convex face, a first edge for connection to the main chord of the boom, and a plurality of tabs projecting from a second edge opposed to the first edge and wherein the one or more plugs comprises a slotted end dimensioned to receive a corresponding one of the tabs.

38. A kit according to claim 37 wherein the one or more plugs comprise a projecting end dimensioned to be received in the lacing member and a flange extending around the projecting end.

39. A method for fabricating or repairing a boom comprising providing a spade connector according to claim 27, attaching the spade connector to a primary chord of the boom and attaching lacing members to the tabs of the spade connector.

40. A method according to claim 39 wherein attaching the spade connector comprises welding the spade connector to the primary chord.

41. A method according to claim 39 wherein the boom is a dragline boom.

42. A method according to claim 41 performed with the dragline boom in a raised configuration.

43. A method according to claim 41 performed with the dragline boom lowered to the ground.

44. A method according to claim 41 performed in-situ while the dragline boom is in the field.

* * * * *